US010092945B2

(12) United States Patent
Bayer

(10) Patent No.: US 10,092,945 B2
(45) Date of Patent: Oct. 9, 2018

(54) APPARATUS FOR AND METHOD OF FORMING A METAL STRUT

(71) Applicant: BAYLOFF DIE & MACHINE CO., INC., Belleville, MI (US)

(72) Inventor: Richard E. Bayer, Northville, MI (US)

(73) Assignee: BAYLOFF DIE & MACHINE CO., INC., Belleville, MI (US)

( * ) Notice: Subject to any disclaimer, the term of this patent is extended or adjusted under 35 U.S.C. 154(b) by 397 days.

(21) Appl. No.: 14/845,301

(22) Filed: Sep. 4, 2015

(65) Prior Publication Data

US 2016/0067764 A1 Mar. 10, 2016

Related U.S. Application Data

(60) Provisional application No. 62/045,993, filed on Sep. 4, 2014.

(51) Int. Cl.

| | |
|---|---|
| ***B21D 11/10*** | (2006.01) |
| ***B21D 53/88*** | (2006.01) |
| ***B21D 11/20*** | (2006.01) |

(52) U.S. Cl.
CPC ..... *B21D 53/88* (2013.01); *B21D 11/10* (2013.01); *B21D 11/203* (2013.01)

(58) Field of Classification Search
CPC ..... B21D 53/88; B21D 11/10; B21D 11/203
See application file for complete search history.

(56) References Cited

U.S. PATENT DOCUMENTS

2005/0257588 A1* 11/2005 Lancaster ..... B21D 22/16 72/84
2013/0152652 A1* 6/2013 Allwood ..... B21D 22/16 72/85

* cited by examiner

*Primary Examiner* — Moshe Wilensky
(74) *Attorney, Agent, or Firm* — John S. Artz; Dickinson Wright PLLC

(57) ABSTRACT

The aspects of the present disclosure provide an apparatus for forming a metal strut mount having a C-shape cross-section and a pair of flanges extending therefrom and a method of forming a metal strut mount utilizing a rolling machine.

9 Claims, 5 Drawing Sheets

APPARATUS FOR AND METHOD OF FORMING A METAL STRUT

RELATED APPLICATIONS

This application claims the benefit of U.S. Provisional Application No. 62/045,993 filed on Sep. 4, 2014, and is incorporated herein.

FIELD OF THE DISCLOSURE

The present disclosure generally relates to an apparatus for and method of forming a metal strut. More specifically, the present disclosure relates to an apparatus for and method of forming a metal strut utilizing a rolling machine.

BACKGROUND OF THE DISCLOSURE

Metal strut components for a vehicle are well-known. Typically, a metal strut is mounted within the vehicle's architecture or body and is used to reinforce the vehicle's architecture or body. Additionally, the strut also provides a dampening function similar to a shock absorber and has the ability to control the transfer of and provide support for side to side vehicle loads.

Metal struts are typically formed from a process utilizing multiple die presses and/or a combination of die presses and roller machines. In particular, a metal sheet may travel through metal stamping dies which may pre-press mount holes and/or bend the metal sheet to form a part of the mount which may be later welded to another part or may form the entire mount after travel through multiple die stations. This manufacturing process can be very time consuming as a result of the part traveling through multiple machines or operational steps. Additionally, such manufacturing process may be very expensive depending on the number of machines which are purchased and operated to form the mount and/or require considerable floor space for the machines required to effectuate this process.

Thus, there is a need for a machine and process for forming a metal strut mount that produces such strut mounts more quickly and more cost efficiently than conventional machines or processes.

SUMMARY OF THE DISCLOSURE

Accordingly, it is an aspect of the present disclosure to provide an apparatus for forming a metal strut mount as well as a method for forming a metal strut mount utilizing a rolling machine.

It is another aspect of the present disclosure to provide a method of forming a metal strut mount that yields more consistent manufacturing from part to part.

It is a further aspect of the present disclosure to provide a method of forming a metal strut that yields improved part tolerances.

It is still another aspect of the present disclosure to provide a method of forming a metal strut mount that allows for the strut opening to be more circular than with prior methods.

It is yet another aspect of the present disclosure to provide a method of forming a metal strut mount that decreases manufacturing time, which permits the manufacture of more parts in a shorter period of time.

It is still yet another aspect of the present disclosure to provide a method of forming a metal strut that decreases manufacturing costs.

In accordance with the above and the other aspects, a rolling machine having a support, a pair of rollers adjacent to the support, and a mandrel with a C-shape cross-section disposed adjacent to the support is provided. A metal sheet having a generally planar surface and a pair of pre-formed flanges extending from the generally planar surface can be disposed in the rolling machine between the support and mandrel with the pair of rollers located over the metal sheet. The pair of rollers can then press the metal sheet down against the mandrel while the pair of flanges move towards one another to roll the metal into the shape of the strut mount.

Another aspect of the present disclosure includes a method of forming a metal strut mount utilizing a rolling machine. The method may include pressing a metal sheet having a generally planar surface and a pair of pre-formed flanges extending outwardly from the generally planar surface over a mandrel with a C-shape cross-section via a pair of rollers forming the metal strut mount.

The aspects disclosed herein provide various advantages. For example, the metal strut mount may be formed by a single machine which is more cost efficient as well as time efficient than existing processes of forming strut mounts that employ stamping operations. Additionally, more metal strut mounts may be made as each metal sheet does not have to go through multiple machines to form the metal strut mount.

BRIEF DESCRIPTION OF THE DRAWINGS

Other aspects of the present disclosure will be readily appreciated, as the same becomes better understood by reference to the following detailed description when considered in connection with the accompanying drawings wherein.

DETAILED DESCRIPTION OF THE PRESENT DISCLOSURE

Detailed examples of the present disclosure are disclosed herein; however, it is to be understood that the disclosed examples are merely exemplary and may be embodied in various and alternative forms. It is not intended that these examples illustrate and describe all possible forms of the disclosure. Rather, the words used in the specification are words of description rather than limitation, and it is understood that various changes may be made without departing from the spirit and scope of the disclosure.

As those of ordinary skill in the art will understand, various features of the present disclosure as illustrated and described with reference to any of the Figures may be combined with features illustrated in one or more other Figures to produce examples of the present disclosure that are not explicitly illustrated or described. The combinations of features illustrated provide representative examples for typical applications. However, various combinations and modifications of the features consistent with the teachings of the present disclosure may be desired for particular applications or implementations.

Figure 1:
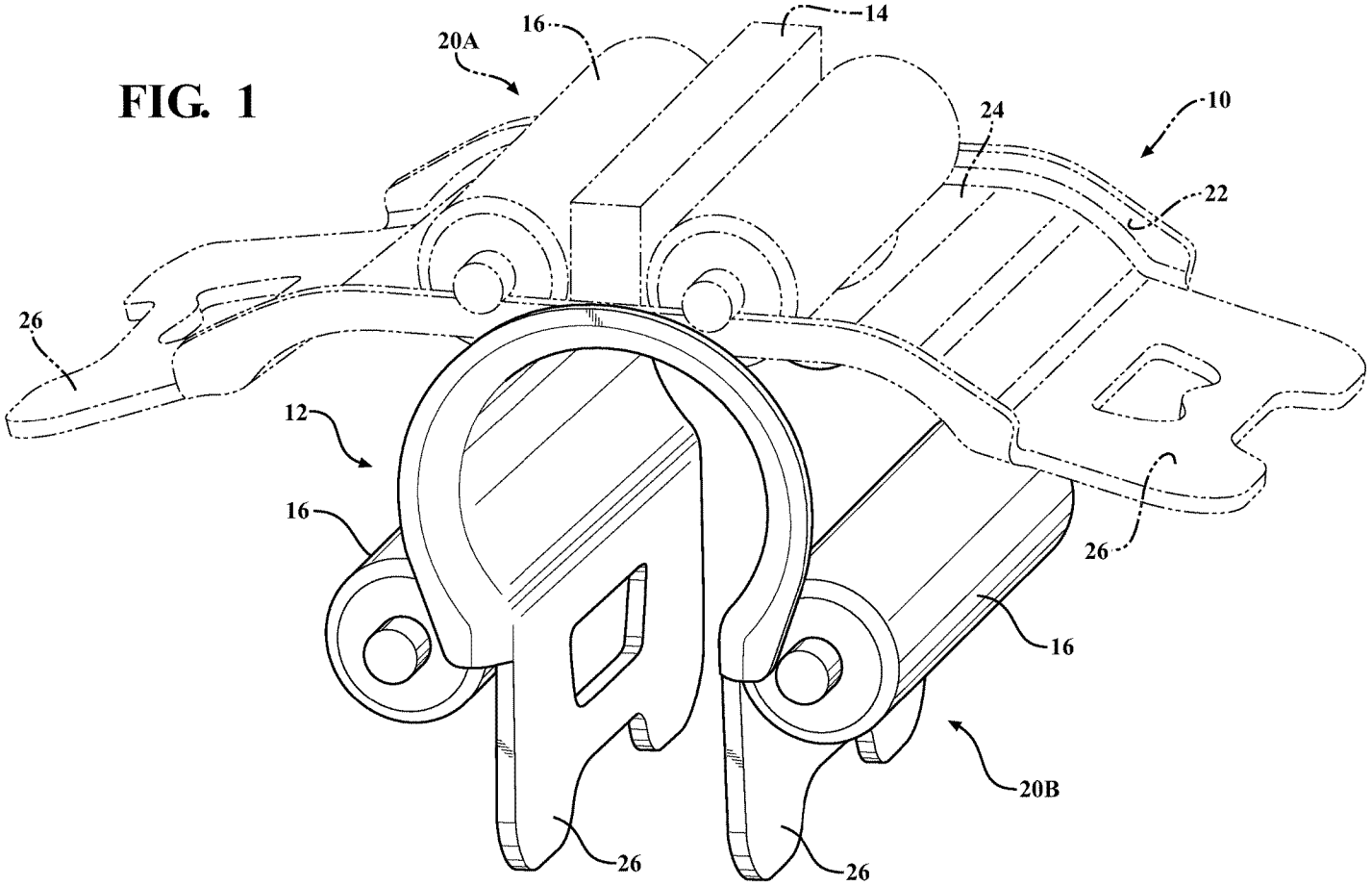
FIG. 1 is a perspective view of a rolling machine for forming a metal strut mount in accordance with an aspect of the present disclosure.

FIG. 1 is an illustration of a rolling machine 10 for forming a metal strut mount 12 in accordance with the present disclosure. According to an aspect, the rolling machine 10 includes a support 14. The support 14 may act as the backbone of the machine. The support 14 may be connected to other machines used in conjunction with the rolling machine 10, for example, in an assembly line or may be operated solely independent of other machines. Instead, the rolling machine 10 may be a standalone machine for forming the metal strut mount 12. The rolling machine 10 may also include a pair of rollers 16 affixed to the support 14. The pair of rollers 16 may be symmetrical and elongated. The pair of rollers 16 may have a first position 20A relative to the support, a second position 20B relative to the support, and a third position 20C relative to the support which will be described in greater detail below. The pair of rollers may have a variety of different configurations and orientations.

A mandrel 18 (shown in FIG. 2B-2C) having a generally circular shape may also be fixed to the support 14. The axis of the mandrel 18 may be parallel to the axes of the pair of rollers 16. The mandrel 18 may provide assistance in shaping and forming the metal strut mount 12. The mandrel 18 may also provide support to the metal strut mount 12 during shaping and formation.

Figure 2A:
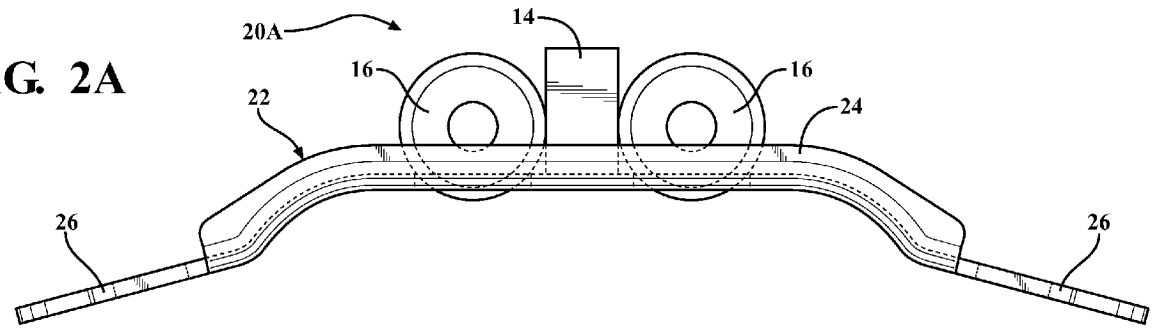
FIGS. 2A-C are illustrations a rolling machine in a first position, a second position, and a third position respectively to form a metal strut mount in accordance with an aspect of the present disclosure.
Figure 2B:
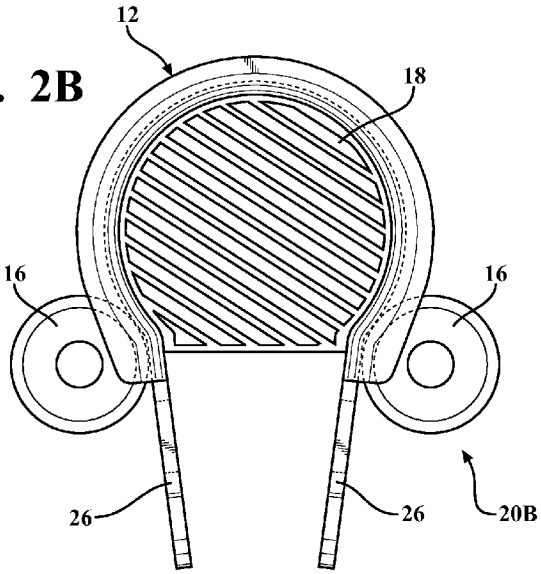
Figure 2C:
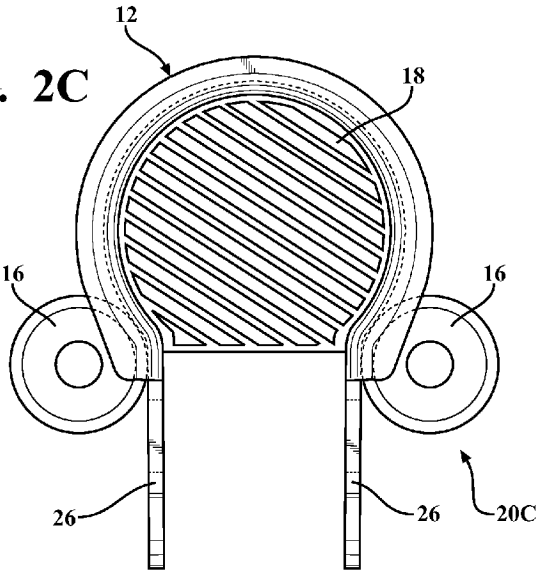

FIG. 1 also includes a metal sheet 22 which forms the metal strut mount 12. The metal sheet 22 may have a generally planar surface 24 and a pair of pre-formed flanges 26 extending outwardly from the generally planar surface 24. In operation, the metal sheet 22 may be placed or fed into the rolling machine 10 between the support 12 and the mandrel 18 by hand or by way of another machine. The generally planar surface 24 of the metal sheet 22 may be tangential to the arc of the mandrel. The pair of rollers 16 may be in a first position 20A above and over the metal sheet 22 as shown in FIG. 2A. The pair of rollers 16 may be adjacent to the support 12 of the rolling machine 10 in the first position 20A. Also in the first position 20A, the pair of rollers 16 may be at the nearest point of travel towards one another. The pair of rollers 16 may then move, press down against the mandrel 18, and roll over the metal sheet 22 to a second position 20B as shown in FIG. 2B. In the second position 20B, the pair of preformed flanges 26 of the metal sheet 22 may converge towards one another to form the metal strut mount 12 such that it has a C-shape cross-section. The pair of rollers 16 can then move to a third position 20C which may allow the preformed flanges 26 of the metal sheet 22 to move into a position parallel from one another as shown in FIG. 2C.

Figure 3:
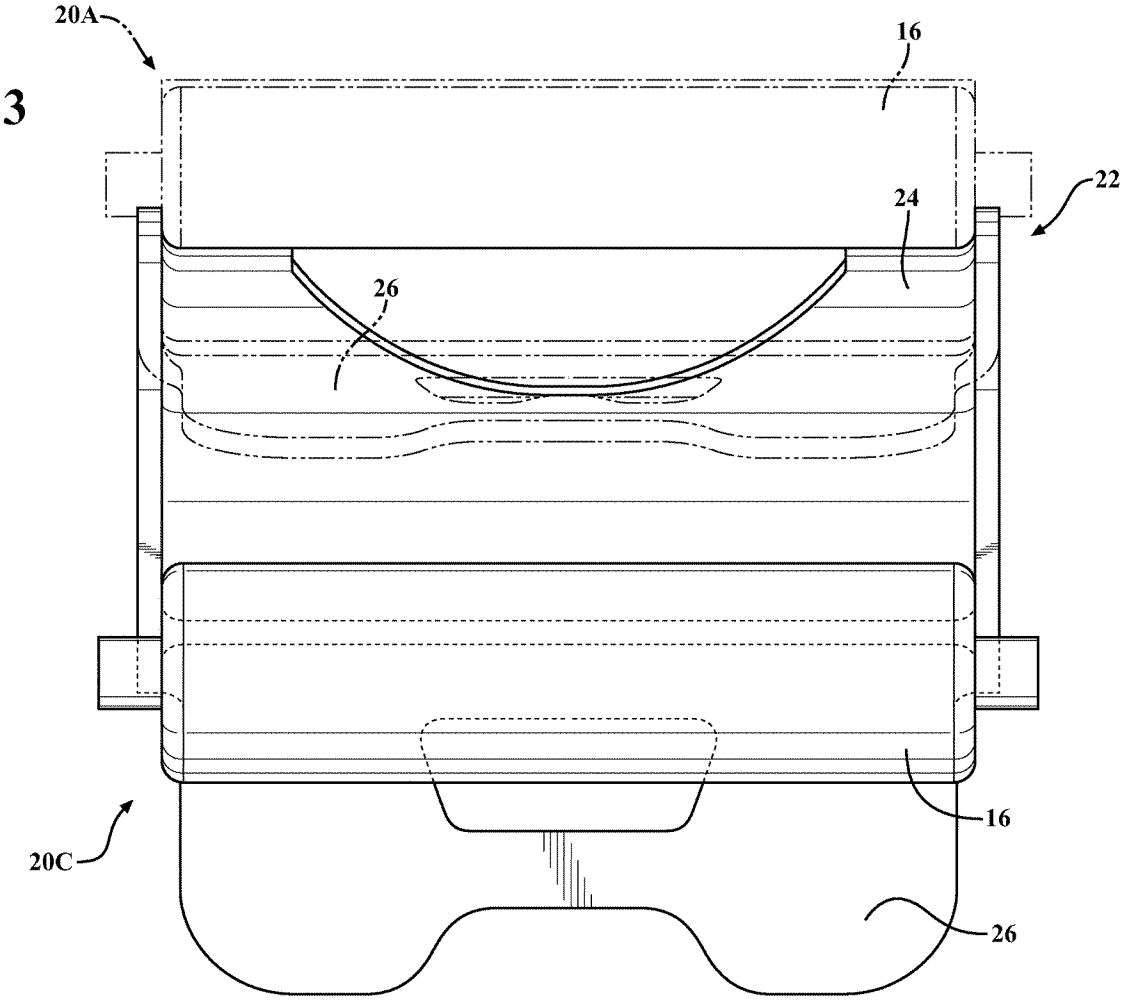
FIG. 3 is a side view of a rolling machine for forming a metal strut mount in accordance with an aspect of the present disclosure.

With respect to FIG. 3, an illustration of a side view of the rolling machine 10 is provided. In particular, FIG. 3 shows one of the pair of rollers 16 and the metal sheet 22 in the first position 20A moving through the second position 20B to the third position 20C discussed above. In the third position 20C, the pair of preformed flanges 26 extending from the generally planar surface (not fully shown) of the metal sheet 22 may be parallel to one another.

Figure 4B:
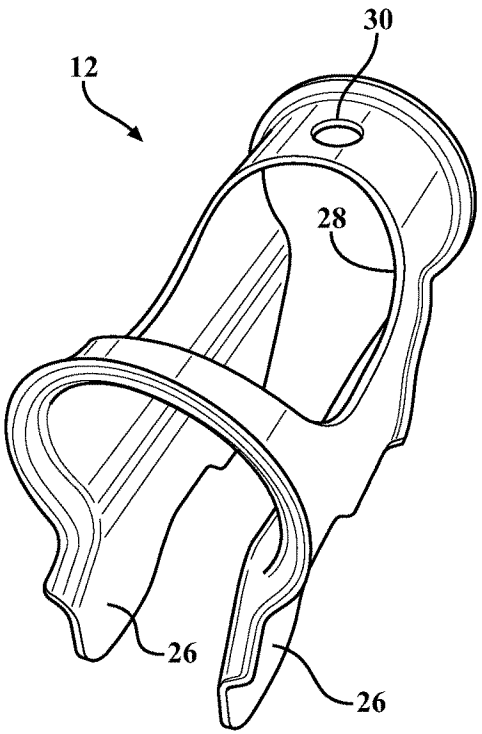
FIGS. 4A-4B are illustrations of a metal strut mount in accordance with an aspect of the present disclosure.
Figure 4A:
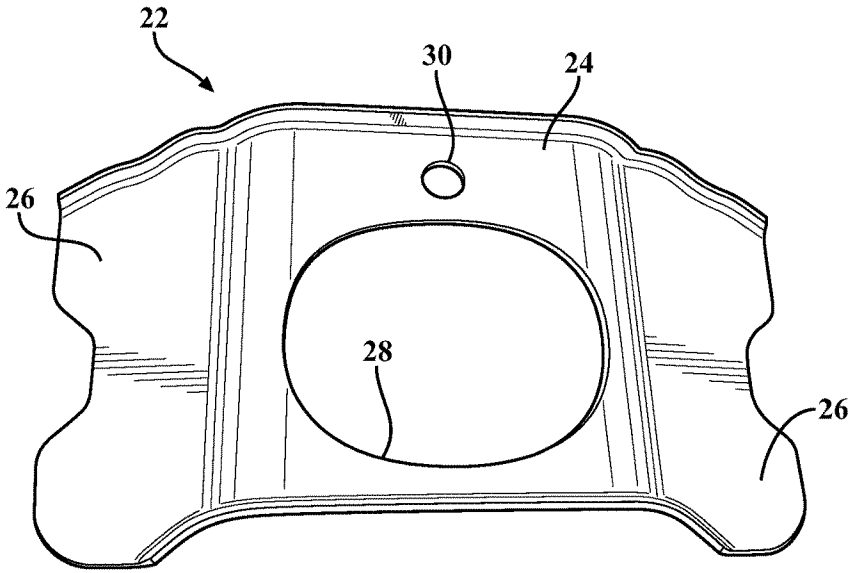

FIGS. 4A-4B are illustrations of a metal strut mount in accordance with an aspect of the present disclosure. More specifically, FIG. 4A is an illustration of the metal sheet 22 discussed above prior to processing through the rolling machine. FIG. 4B is an illustration of the metal sheet 22 formed into the metal strut mount 12 by the rolling machine. With respect to FIG. 4A, the metal sheet 22 may have a generally planar surface 24 and a pair of preformed flanges extending outwardly from the generally planar surface 24 as previously discussed. Additionally, the metal sheet 22 may have a generally raised edge surrounding all or part of the metal sheet 22. The generally planar surface 24 of the metal sheet 22 may have a large aperture 28 for receiving a mounting piece. The generally planar surface 24 of the metal sheet 22 may also have a small aperture 30 for receiving a bore, bolt, dowel, or the like.

As discussed above, FIG. 4B shows the metal sheet 22 can be formed into the metal strut mount 12 after the metal sheet 22 has proceeded through the rolling machine 10. The metal strut mount may have a C-shape cross-section 32 and may have the pair of preformed flanges 16 extending from the C-shape cross-section 32. The pair of preformed flanges 16 may be parallel to one another. The metal strut mount 12 may also include a bracket (not shown) disposed within the C-shape cross-section and between the pair of preformed flanges 16. Additionally, the metal strut mount 12 may have a large aperture 28 and may also have a small aperture 30 for receiving a mounting piece, a bore, a bolt, a dowel, or the like.

Figure 5:
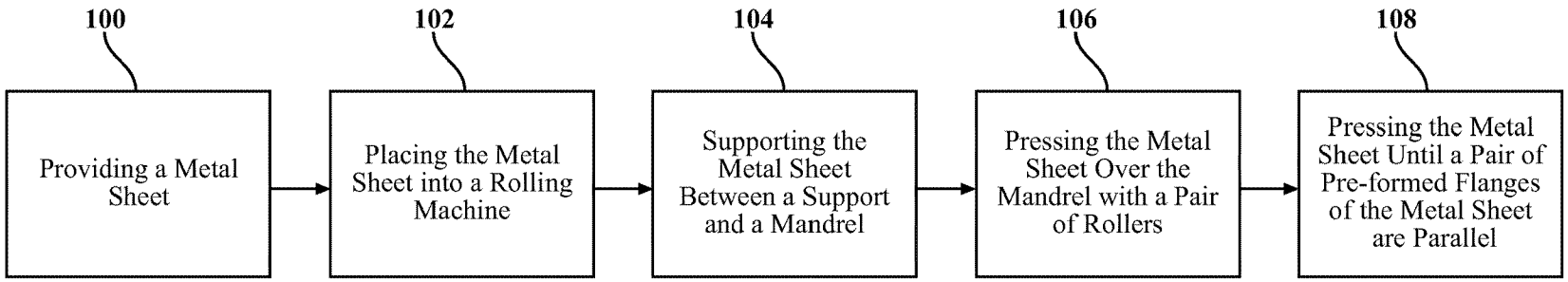
FIG. 5 is a flowchart of a method for forming a metal strut mount using a rolling machine in accordance with an aspect of the present disclosure.

FIG. 5 is a flowchart of a method for forming a metal strut mount using a rolling machine in accordance with the present disclosure. The method may include providing a metal sheet 100. The metal sheet may have a generally planar surface and a pair of pre-formed flanges extending outwardly from the generally planar surface. The generally planar surface may also have a large aperture and a small aperture for receiving a mounting piece, a bore, a bolt, a dowel, or the like. The metal sheet may be fed or placed into the rolling machine 102. The metal sheet may be supported or braced on a support of the rolling machine adjacent to a mandrel 104. The mandrel may have a C-shape cross-section and the metal sheet may be generally tangential to the C-shape cross-section of the mandrel. A pair of rollers may also be adjacent to the support in a first position 20A over the metal sheet.

The method may further include pressing and/or rolling the pair of rollers over the mandrel and against the metal sheet towards each other to a second position 20B so as to form a C-shape cross-section within the metal sheet 106. In the second position 20B, the pair of pre-formed flanges may be pressed towards one another. The pair of rollers then may continue to press and/or roll against the metal sheet to reach a third position 20C which may cause the pair of pre-formed flanges to be parallel with one another and forms the metal strut mount 108. The metal strut mount may have a generally C-shape cross-section with a pair of flanges extending therefrom. A bracket may be placed between the pair of flanges to close the C-shape cross-section and for added support for use in a vehicle.

While examples of the disclosure have been illustrated and described, it is not intended that these examples illustrate and describe all possible forms of the disclosure. Rather, the words used in the specification are words of description rather than limitation, and it is understood that various changes may be made without departing from the spirit and scope of the disclosure. Additionally, the features and various implementing embodiments may be combined to form further examples of the disclosure.

I claim:

1. A rolling machine for forming a metal strut mount for use on an assembly line, comprising:

a support being stationary for holding a metal sheet in place within the rolling machine;

a pair of rollers each extending along and rotatable about a roller axis and coupled to and movable relative to the support;

a mandrel being stationary and affixed to the support in a spaced relationship with the support and adjacent to the pair of rollers, the mandrel extending along a mandrel axis extending in parallel to the roller axis of each of the pair of rollers and having a generally circular cross-section for molding the metal sheet into a metal strut mount using the pair of rollers;

each of the pair of rollers being movable in opposite facing arc-shaped paths each originating from the support and about the mandrel axis between a plurality of positions; and wherein the metal sheet is fed into the rolling machine such that the support and pair of rollers engage one side of the metal sheet and such that the mandrel engages an opposite side of the metal sheet, and wherein the pair of rollers are configured to move between the plurality of positions and press the metal sheet against the mandrel to form the metal strut mount.

2. The rolling machine of claim 1, wherein the arc-shaped paths of each of the pair of rollers mirror one another when viewing into the mandrel axis.

3. The rolling machine of claim 2, wherein the plurality of positions includes a first position with each of the pair of rollers being on a first side of the mandrel proximal to and on opposite sides of the support and a second position and a third position with each of the pair of rollers being on a second side of the mandrel opposite the first side and disposed remotely from the support.

4. The rolling machine of claim 3, wherein the first position includes the pair of rollers in a position adjacent to the support and at the nearest point of travel towards one another.

5. The rolling machine of claim 3, wherein the second position includes the pair of rollers pressing the metal sheet against the mandrel such that a pair of pre-formed flanges of the sheet metal converge towards one another forming a C-shape cross-section.

6. The rolling machine of claim 3, wherein the third position includes pressing the metal sheet against the mandrel such that a pair of pre-formed flanges of the sheet metal are parallel to one another.

7. The rolling machine of claim 1, wherein each of the pair of rollers are symmetrical and elongated along the roller axis.

8. The rolling machine of claim 2, wherein the plurality of positions includes a first position and shifting the pair of rollers from the first position to a second position, and wherein the first position has the pair of rollers in a position adjacent to the support and at the nearest point of travel towards one another and the second position has the pair of rollers pressing the metal sheet against the mandrel such that the pair of pre-formed flanges converge towards one another forming a C-shape cross-section.

9. The rolling machine of claim 8, wherein the plurality of positions further includes shifting the pair of rollers from the second position to a third position, and wherein the third position has the pair of rollers pressing the metal sheet against the mandrel such that a pair of pre-formed flanges of the sheet metal are parallel to one another.

* * * * *